United States Patent [19]

Ferreol-Ragotin

[11] Patent Number: 4,950,349

[45] Date of Patent: Aug. 21, 1990

[54] ENVELOPE FLAP FOLDING DEVICE

[75] Inventor: André Ferreol-Ragotin, Evry, France

[73] Assignee: Societe Anonyme dite : SMH Alcatel, Paris, France

[21] Appl. No.: 282,171

[22] Filed: Dec. 9, 1988

[51] Int. Cl.[5] ..... B43M 5/00; B43M 5/04

[52] U.S. Cl. ..... 156/442.1; 156/441.5; 156/442.2; 156/443; 156/555; 156/199; 156/204; 156/227

[58] Field of Search ..... 156/442.1, 441.5, 442.2, 156/555, 443, 227, 204, 200, 199; 118/32; 53/383; 493/436

[56] References Cited

U.S. PATENT DOCUMENTS

| | | | |
|---|---|---|---|
| 709,761 | 9/1902 | Gavitt | 156/442.1 |
| 1,090,771 | 3/1914 | White | 156/442.2 |
| 1,096,309 | 5/1914 | Markoe | 156/442.1 |
| 1,146,746 | 7/1915 | Albrecht | 156/442.1 |
| 2,301,354 | 11/1942 | Alden, Jr. . | |
| 3,811,407 | 5/1974 | Lupkas | 118/264 X |
| 3,974,749 | 8/1976 | Luperti et al. . | |
| 4,380,210 | 4/1983 | Auerbach | 118/235 |
| 4,387,000 | 6/1983 | Tancredi | 156/555 X |
| 4,606,784 | 8/1986 | Glans et al. | 156/443 X |
| 4,649,691 | 3/1987 | Buckholz . | |
| 4,672,705 | 6/1987 | Bors et al. | 118/249 X |

*Primary Examiner*—Michael W. Ball
*Assistant Examiner*—Jeff H. Aftergut
*Attorney, Agent, or Firm*—Sughrue, Mion, Zinn, Macpeak & Seas

[57] ABSTRACT

A device for folding over the flaps of envelopes received separately with the flap open at the entry to a guide path comprises a feed system for moving the envelopes along the guide path and a deflector system for folding the flaps of the envelopes over from an open position to a closed position. The deflector system comprises first and second pulley wheels with parallel rotation axes disposed with respect to the entry to the guide path and one on each side of this path so as to receive the envelopes between them. The first pulley wheel faces towards the front of the envelopes and has a stepped peripheral surface formed by a cylindrical first portion adapted to bear on at least that portion of each envelope adjoining the flap and a frustoconical second portion running on from this first portion and widening towards the flaps of the envelopes. The second pulley wheel has a peripheral surface formed by a cylindrical first portion opposite the first portion of the first pulley wheel and set back relative to the envelopes and a projecting disk at the end of this first portion situated beneath the frustoconical portion of the first pulley wheel. The disk is substantially aligned with the junction between the first and second portions of the first pulley wheel in order fold the flaps of the envelopes down from the open position to an intermediate position in which the flap is substantially perpendicular to the remainder of the envelope.

24 Claims, 8 Drawing Sheets

ENVELOPE FLAP FOLDING DEVICE

BACKGROUND OF THE INVENTION

1. Field of the invention

The present invention concerns automatic mail handling. It relates specifically to an envelope flap folding device for closing filled envelopes.

2. Description of the prior art

A device of this kind may form part of an inserter machine into which it is integrated. In this case the inserter machine is supplied with separate enclosures from a folding device and empty envelopes from an envelope unstacker. It incorporates a device for transferring empty envelopes to an insertion station where they are held open, a device for transferring the enclosures and inserting them into the successive envelopes presented to the insertion station (a transfer and insertion carriage, for example), a device for ejecting filled but still open envelopes and a device for folding down the flap of the ejected envelopes.

As an alternative to this a device of this kind may be semi-independent of any inserter machine and simply coupled to the output from the device for ejecting filled envelopes which feeds it or totally independent of an inserter machine and coupled to an envelope unstacker taking envelopes one by one from a magazine in which they are stored filled and with their flap wide open.

As a general rule the flaps of envelopes presented open are folded down as they move along a guide path. After the flaps are folded down the guide path can in turn feed a subsequent processing device such as a franking machine or a stacker.

U.S. Pat. No. 3 811 407 describes a device of this kind designed to feed a franking machine. In the embodiment described in this document the open envelopes are received separately on a platform which constitutes the envelope guide path. The body of the received envelopes rests on and is fed along the upper surface of the platform whereas the flap projects beyond one edge of the platform and hangs freely. A first deflector member guides the flap and applies it against a moistening member mounted under the platform and comprising a wick supplied from a water reservoir into which it dips. This first deflector member has a complex shape in order to guide the flap and press its gummed region firmly against the wick. It extends beyond the moistening member and/or is associated with a second deflector member to guide the moistened flap above the platform through an opening in the platform where a pressure plate then stick it to the body of the envelope, in order to feed the latter to the franking machine.

This known device is large and its structure is relatively complex. The device has the disadvantage of relating the flap folding operation to the moistening operation so that at the end of folding the flap is fixed in a definitive way to the body of the envelope. It is therefore not suitable for automatic handling of mail that can be sent sealed or unsealed, unsealed mail being sendable at reduced cost.

An object of the present invention is to provide an envelope flap folding device avoiding these disadvantages.

SUMMARY OF THE INVENTION

The invention consists in a device for folding over the flaps of envelopes received separately with the flap open at the entry to a guide path, the device comprises feed means for moving the envelopes along said path and deflector means for folding the flaps of the envelopes over from an open position to a closed position and said deflector means comprising first and second pulley wheels with parallel rotation axes disposed with respect to said entry and one on each side of said path so as to receive the envelopes between them, wherein said first pulley wheel is adapted to face towards the front of the envelopes and has a stepped peripheral surface formed by a cylindrical first portion adapted to bear on at least that portion of each envelope adjoining the flap and a frustoconical second portion running on from said first portion and widening towards the flaps of the envelopes and said second pulley wheel has a peripheral surface formed by a cylindrical first portion opposite said first portion of said first pulley wheel and set back relative to the envelopes and a projecting disk at the end of said first portion situated beneath said frustoconical portion of said first pulley wheel and substantially aligned with the junction between said first and second portions of said first pulley wheel in order to fold the flaps of the envelopes down from said open position to an intermediate position in which the flap is substantially perpendicular to the remainder of the envelope.

The device preferably further comprises a deflector flap facing said first pulley wheel and said disk of said second pulley wheel and extending downstream of said pulley wheels in the direction of movement of the envelopes along said path to constitute an obstacle preventing the flaps of the envelopes from unfolding, said deflector flaps and said pulley wheels together constituting a folding station.

In a preferred embodiment said first and second pulley wheels are mounted on respective shafts and said shafts carry respective first rollers of a first pair of pressure roller forming part of said feed means.

Said guide path is preferably formed by a U-shaped cross-section horizontal channel on the bottom of which the bottom edges of the envelopes rest as they are fed along said channel in a vertical position.

In a preferred embodiment the device comprises downstream of the pulley wheels and the flap a moistening station incorporating a moistening roller receiving the gummed part of the envelope flap and a counter-roller movable between a position pressed against the moistening roller to moisten the gummed part and a retracted position to allow the envelope flap to pass freely without moistening the gummed part.

This moistening station is advantageously adjustable transversely of the guide path and carried by an envelope flap closing station mounted downstream on the end part of the path.

In a preferred embodiment the closing station comprises a closing system incorporating a pair of drive rollers pressed against each other and spaced from the path so as not to be in direct contact with the envelopes on the path and a transfer system linking the closing system and the channel transferring envelopes from the channel to the closing system with the start of their flap to the front.

An abutment member preferably stops envelopes fed from the moistening station in the transfer system. A check pawl advantageously prevents envelopes stopped against the abutment member returning into the moistening station.

The characteristics and advantages of the present invention will emerge more clearly from the following description of one embodiment thereof given by way of non-limiting example only and with reference to the appended diagrammatic drawings.

DESCRIPTION OF THE PREFERRED EMBODIMENT

Figure 1:
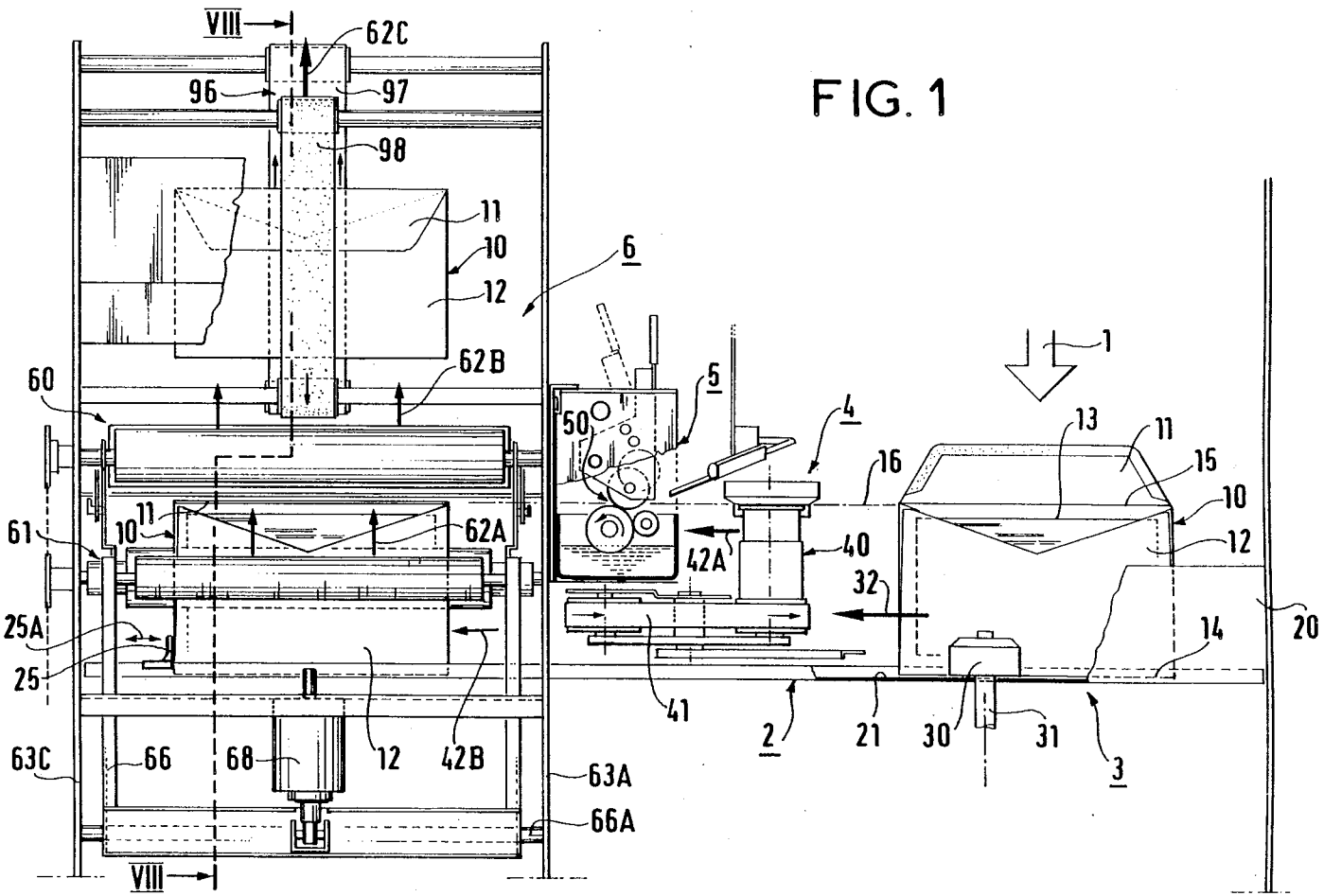
FIG. 1 is a schematic overall view of an envelope flap folding device in accordance with the present invention.

In the overall view of the folding device shown in FIG. 1 the arrow 1 represents the feeding of envelopes to the device, the device or machine supplying the envelopes being deliberately omitted. The envelopes 10 are received on an envelope guide 2 in an entry station 3 of the folding device. They arrive separately in the entry station 3 with their flap 11 open, substantially in line with the body 12 of the envelope. They have been filled previously and contain an enclosure 13. The entry station 3 is defined on the guide path 2. It constitutes the input of the device. It is formed over a length of the path 2 which is at least equal to the maximum length of the envelopes processed by the folding device.

The direction of the feed arrow 1 in FIG. 1 reflects the fact that the envelopes are fed from above the guide path 2. As alternatives to this, they may equally well be fed from the end or from one lateral side of the path 2, depending on its nature. The received envelopes rest on the guide path 2.

Starting from the entry station 3, the envelope flap folding device in accordance with the invention comprises the consecutive stations along the path 2:

- a flap folding station 4 receiving the envelopes from the entry station 3 and in which the flap is initially folded to an intermediate position between the initial open position and the closed position,
- a moistening station 5 receiving the envelopes from the folding station 4 and in which the gummed part of the flap is moistened or not, as required, and
- an envelope closing station 6 receiving the envelopes that have passed through the moistening station 5 and delivering them with their flap 11 folded down against their body 12, as shown.

The folding station 4 incorporates a system 40 for folding down the flaps. The moistening station 5 incorporates a moistening system 50. The closing station 6 incorporates a closing system 60.

In the embodiment as shown in FIG. 1 the closing station 6 is disposed above the guide path 2, just downstream of the folding station 4 and the moistening station 5. The guide path 2 is formed by a U-shaped channel of which one of the vertical side members, the so-called larger side member 20, has been sketched in. The envelopes o the guide path rest with their bottom edge 14 on the bottom 21 of the channel. A transverse abutment member 25 stops the envelopes on the guide path opposite the closing station. The stop member 25 is at a distance from the moistening station 6 at least equal to the length of the envelopes used. This distance is preferably adjustable as shown by the arrow 25A according to the lengths of the various envelope formats, so as to center the envelopes opposite the closure system 60 or to enable tamping of the envelopes against the same lateral member irrespective of their size.

The closing station 6 is also provided with a system 61 for transferring envelopes from the channel to the closing system 60.

This arrangement procures a reversal of the path of the envelopes in the device in accordance with the invention. It makes the final folding of the flap from its intermediate position to the closed position particularly easy, as will become clear later. It also limits the length of the guide path 2 and results in a compact overall arrangement.

As an alternative to this, of course, as with the feeding of envelopes into the device, the closing station could be disposed laterally of or in line with the guide path 2, depending on the nature of the guide path 2.

The folding device further comprises means for feeding the envelopes from the entry station 3, through the folding station 4 and the moistening station 5 and into the closing station 6. These feed means operate on the body of the envelopes to advance them along the guide path 2. The envelopes received vertically into the entry station of the guide path constituted by the U-shaped channel are fed in this vertical position along the guide path. The line 15 at which its flap 11 joins to its body 12 is shown on the envelope 10. The chain-dotted line 16 above the channel shows the level relative to the bottom 21 of the channel of this start 15 of the fold as the envelope moves along the channel.

The feed means comprise a drive roller (not shown) and an associated counter-roller 30 disposed on opposite sides of the part of the path 2 upstream of the folding station 4 and the moistening station 5 and defining with this part of the path 2 the entry station. The counter-roller 30 is mounted at the end of a pivoting arm 31 that can be rotated by a solenoid (not shown) in order to retract the counter-roller relative to the roller with which it is associated. The envelopes are fed from the entry station 3 to the folding station and the moistening station 5 when the counter-roller 30 is pressed against the other roller to grip the envelope body between them, as shown by the arrow 32.

The feed means further comprise a pair of drive belts one on each side of the path 2 of which only the belt 41 is visible. The pair of belts is on the same support as the folding system 40 of the folding station 41. It feeds the envelopes into the folding station 4 and the moistening station 5 as shown by the arrow 42A and downstream of the stations, as shown by the arrow 42B, it conveys the successive envelopes into the extraction system 61 of the closing station 6.

The path of the envelopes in the closing station 6 is shown by the arrow 62A associated with the extractor system 61, the arrow 62B associated with the closing system 60 and the arrow 62 at the exit from this station.

FIG. 1 shows that the general arrangement of the folding device in accordance with the invention remains unchanged even if the envelopes are received and fed flat on a horizontal platform. A horizontal platform of this kind may be regarded as similar to one of the side members, for example the side member 20, disposed horizontally so that the body of the envelope rests on it, with the envelope flap projecting beyond one of its longitudinal edges.

The folding station 4, moistening station 5 and closing station 6 forming part of the folding device as shown in FIG. 1 are described in more detail with reference to FIGS. 2 through 8. In these figures components already mentioned with reference to FIG. 1 are identified by the same reference numbers.

Figure 2:
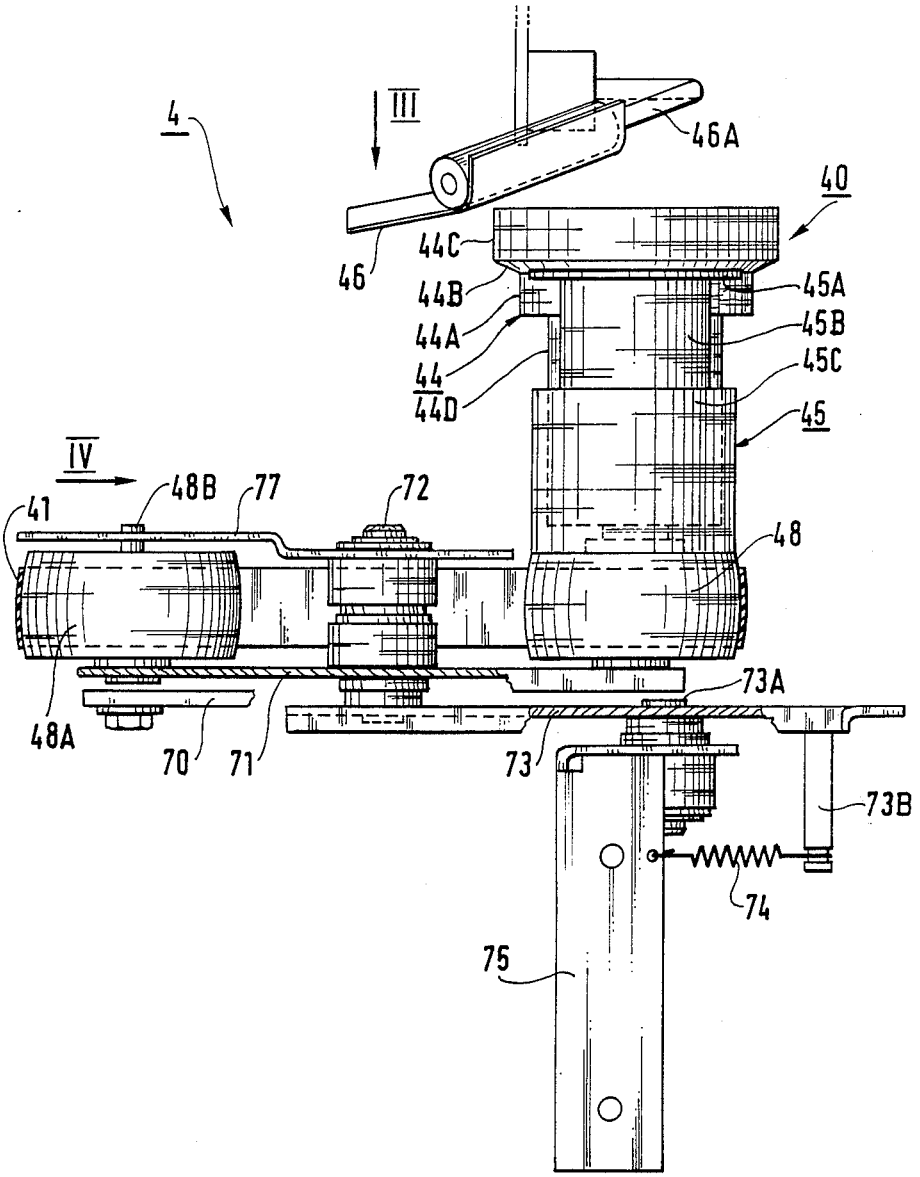
FIG. 2 is an elevation view of an envelope flap folding station forming part of the device from FIG. 1.
Figure 3:
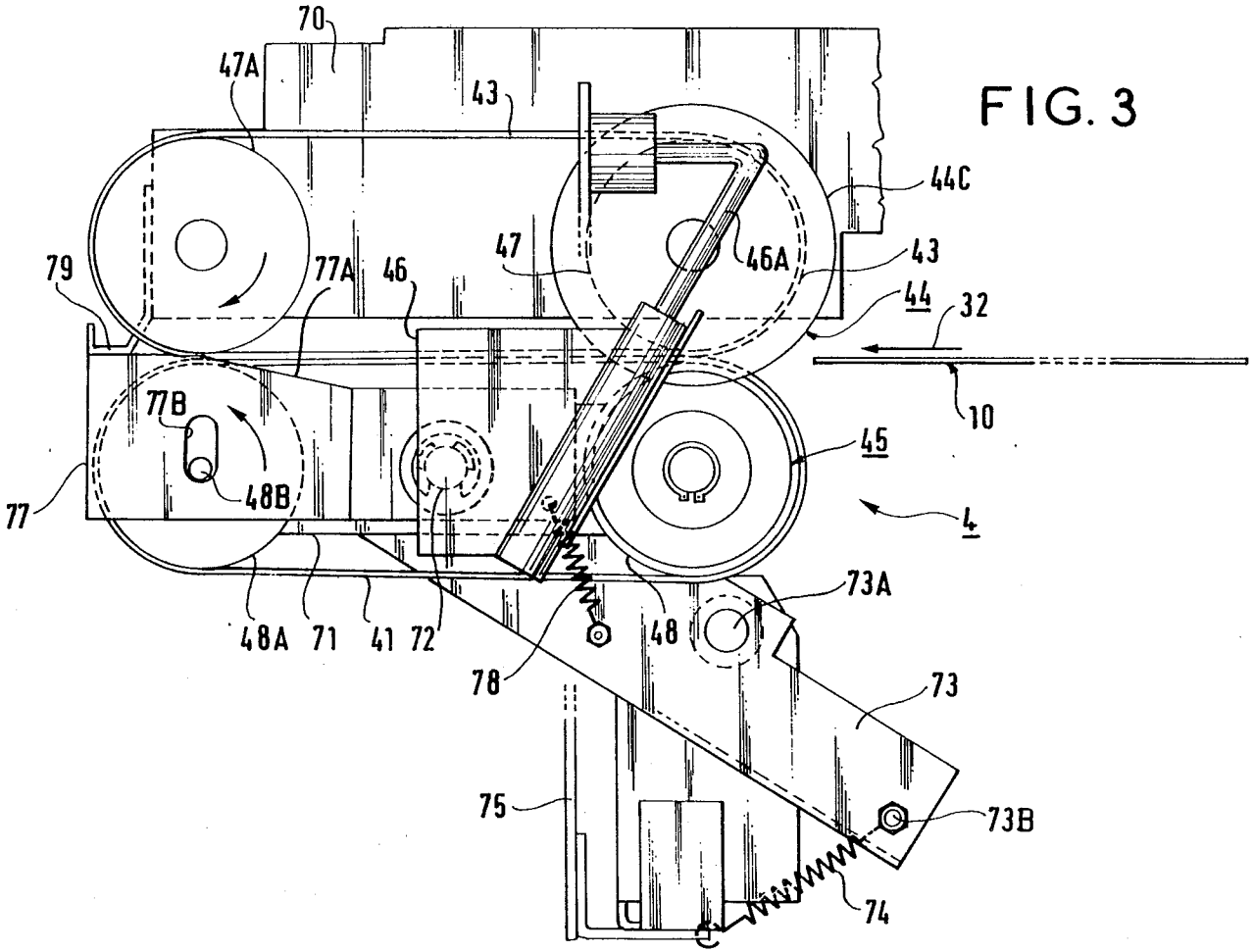
FIG. 3 is a plan view of said folding station as seen from above in the direction of the arrow III in FIG. 2.
Figure 4:
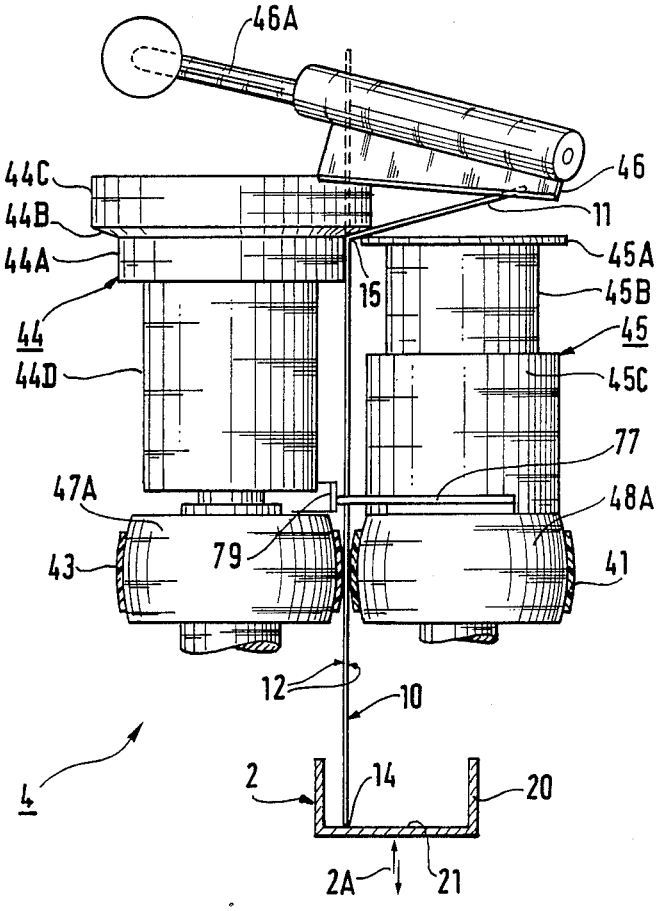
FIG. 4 is a side view of said folding station as seen in the direction of the arrow IV in FIG. 2.

FIGS. 2, 3 and 4 shown the folding station 4. In this station 4 the folding system 40 essentially comprises a pair of pulley wheels 44 and 45. These pulley wheels have their axis vertical and are disposed one on each side of the guide path 2 to receive the envelopes between them. A deflector flap 46 associated with them extends their action.

The arrangement and relative disposition of the pulley wheels 44 and 45 is shown very clearly in FIG. 4. The pulley wheel 44, with which the front surface of the envelope comes into contact, has a stepped peripheral surface. This stepped peripheral surface defines in succession a cylindrical first portion 44A against which the upper part 12 of the envelope 10 rests, a divergent frustoconical second portion 44B above the first portion, and a cylindrical third portion 44C.

This third portion forms the upper end part of the pulley wheel 44. It projects radially beyond the first portion to which it is joined by the frustoconical portion. The junction between the frustoconical portion 44B and the first portion 44A is level with the line of intersection 15 between the flap 11 and the body 12 of the envelope. It therefore has applied against it at least that part of the flap which is adjacent the body of the envelope in order to fold the flap.

The pulley wheel 44 also extends towards the bottom 21 of the U-shaped channel 2 the side members of which are cut off short level with the pulley wheels 44 and 45. The peripheral surface defines in addition to the previously mentioned three portions 44A, 44B and 44C a cylindrical fourth portion 44D projecting less far than the first portion 44A which it extends downwardly towards the bottom 21 of the channel. This fourth portion is considerably set back relative to the body 12 of the envelope.

The pulley wheel 45, facing the pulley wheel 44, has its periphery set back from the body 12 of the envelope. It forms at its upper end a projecting disk 45A. The projecting disk 45A is level with the junction between the cylindrical first portion 44A and the frustoconical second portion 44B of the pulley wheel 44. It is inserted beneath the frustoconical second portion 44B of the pulley wheel with a gap left between it and the pulley wheel 44 for the flap 11 of the envelope to pass through, forced to fold on the start 15 of the flap 11. Beneath the projecting end 45A the peripheral surface of the pulley wheel 45 defines a cylindrical first portion 45B facing the cylindrical first portion 44A and part of the fourth portion 44D of the pulley wheel 44. It then defines a cylindrical second portion 45C projecting further than the first portion 45B but nevertheless slightly set back relative to the body of the envelope.

The deflector flap 46 is mounted just above the upper end of the two pulley wheels. Referrring to FIGS. 2, 3 and 4 it is seen that the deflector flap 46 is carried by a cranked support arm 46A fixed to a flange (no reference number) of the device. The support arm 46A is inclined to the line between the pulley and to the horizontal. It is substantially vertically aligned with the axis of the pulley wheel 44 and downstream of the axis of the pulley wheel 45.

The deflector flap extends from the support arm which carries it downstream of the two pulley wheels 44 and 45 above the envelope guide path. Over the guide path it extends laterally on the side of the pulley wheel 45 at least to the width of the envelope flap. It receives against it the reverse side of the flap as soon as the flap is forced to fold by the two pulley wheels. It therefore extends their action downstream along the guide path and maintains the applied folding as far as the moistening station 5.

Referring to FIG. 2 and/or FIG. 3 it is seen that the pulley wheels 44 and 45 carry at their lower end respective rollers 47 and 48 mounted on the axis of the pulley wheel concerned. The roller 47 is a drive roller providing a friction drive to the roller 48 through the intermediary of the belts that they carry. The aforementioned belt 41 and the other drive belt 43 facing it are mounted on the respective pairs of rollers. The belt 41 runs on one side of the path 2 between the roller 48 and a roller 48A further downstream along the path. The belt 43 likewise runs on the other side of the path between the roller 47 and a roller 47A further downstream along the path and facing the roller 48A. The two belts 41 and 43 are pressed against each other to grip between them the lower part or a substantially central part of the body 12 of the envelope and so entrain the envelope. The drive rollers 47 and 48 also drive the two pulley wheels 44 and 45 and impart to the latter the same rotation speed as they have themselves.

FIGS. 2 and 3 also show that each pulley wheel 44 or 45, the roller 47 or 48 that the pulley wheel in question carries and the associated downstream roller 47A or 48A is mounted on the same support 70 or 71.

One of the combinations defined by one of the pulley wheels and the two rollers on the same side of the path on their support, in this case the pulley wheel 45 and the rollers 48 and 48A on the support 71, is disposed to be urged by spring means against the other combination defined by the pulley wheel 44 and the rollers 47 and 47A on their support 70.

To this end the support 71 is mounted to pivot on an intermediate shaft 72 and is coupled by this shaft to a link 73. The shaft 72 is substantially half way between the rollers 48 and 48A. The link has one end pivoted on the shaft 72. It is also articulated about a fixed shaft 73A which supports it. A spring 74 is coupled to its other end at 73B and to a flange 75 of the device, referred to as the folding station flange. The spring acts on the link 73 and the support 71 to press the rollers 48 and 48A against the facing rollers 47 and 47A. It also enables resilient movement of one or other of the rollers 48 and 48A, opposing its own action, when an envelope filled to a greater or lesser degree and therefore having a greater or lesser thickness passes between each pair of rollers 47, 48 or 47A, 48A.

To achieve adequate strength, the support 71 has an inverted U-shape in transverse cross-section and the link 73 has an L-shape in transverse cross-section.

A pawl 77 for preventing envelopes returning into the guide path is associated with the roller 48A. It is mounted above the roller 48A and extends upstream and also slightly downstream of this roller along the guide path. It comprises a flat member transversely disposed relative to the envelope bodies. Its end 77A facing the envelope bodies is initially set back relative to the envelope body, its part upstream of the roller 48A is on the slant in a direction substantially tangential to the roller 48A and its part downstream of the roller 48A projects slightly beyond the periphery of the roller 48A.

FIGS. 2 through 4 show that the pawl 77 is coupled to the roller 48A and pivots about the aforementioned shaft 72 by which it is coupled with the support 71 to the link 73.

For coupling it to the roller 48A it incorporates a slot 77B extending along the line between the rollers 48A and 47A. A pin 48B centered on the axis of the pulley wheel 48A is retained in this slot 77B. A spring 78 couples the end part of the pawl upstream of the shaft 72 to the link 73 near its fixed articulation axis 73A. Facing the envelope 11 entrained along the guide path as shown by the arrow 32, it operates on the pawl so that its part downstream of the roller 48A projects slightly beyond the roller 48A into the envelope guide path when there is no envelope between the rollers 47A and 48A. On the other hand, when an envelope passes between them, the same downstream part of the pawl is retracted from the path with the roller 48A. The coupling provided by the pin 48B in the slot 77B provides clearance between the roller 48A and the pawl 77 whereby the pawl no longer projects beyond the roller into the path 2. Immediately an envelope has passed the rollers 47A and 48A and stopped at the stop member 25 (FIG. 1) the pawl projects again and then forms an obstacle preventing retrograde movement of the envelope between the rollers in the event of any rebounding of the envelope from the stop member.

As shown in FIG. 3, a counter-pawl 79 is disposed facing the downstream end part of the pawl 77 which abuts against it to close the envelope path in the absence of an envelope. The counter-pawl 79 is fixed, being attached to the support 70.

In this folding station 4 the pulley wheels 44 and 45, the rollers that they carry and the downstream rollers 47, 48 and 47A, 48A are fixed in terms of height within the device. On the other hand, as symbolically shown in FIG. 4 with reference to the folding station or in FIGS. 7 and 8 with reference to the moistening and closing stations to which these refer, the channel 2 is adjustable in height within the device. The arrows 2A represent this adjustment, which enables the device to receive different envelope formats without altering the heights of the various stations 3 through 6.

Figure 5:
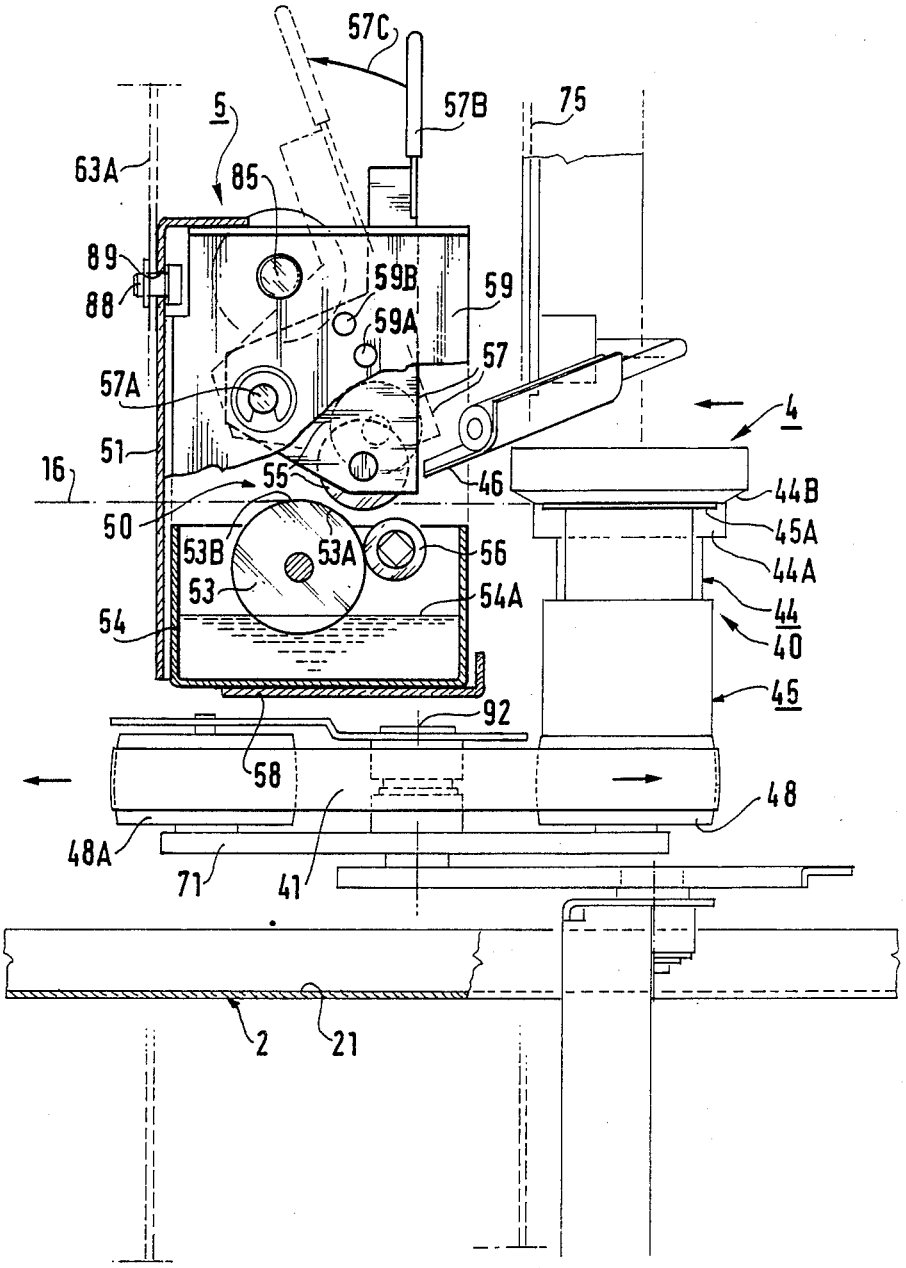
FIG. 5 is a partially cut away view in elevation of a moistening station forming part of the device from FIG. 1, within which it is associated with said folding station.
Figure 6:
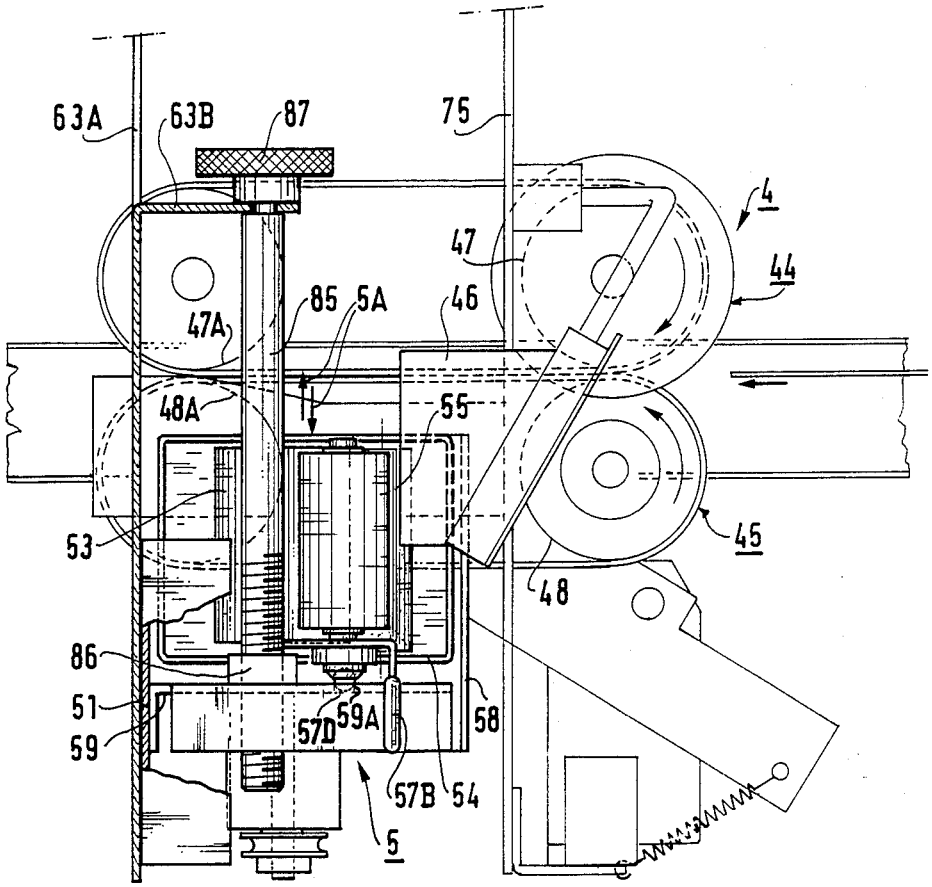
FIG. 6 is a plan view of the moistening station shown in FIG. 5.
Figure 7:
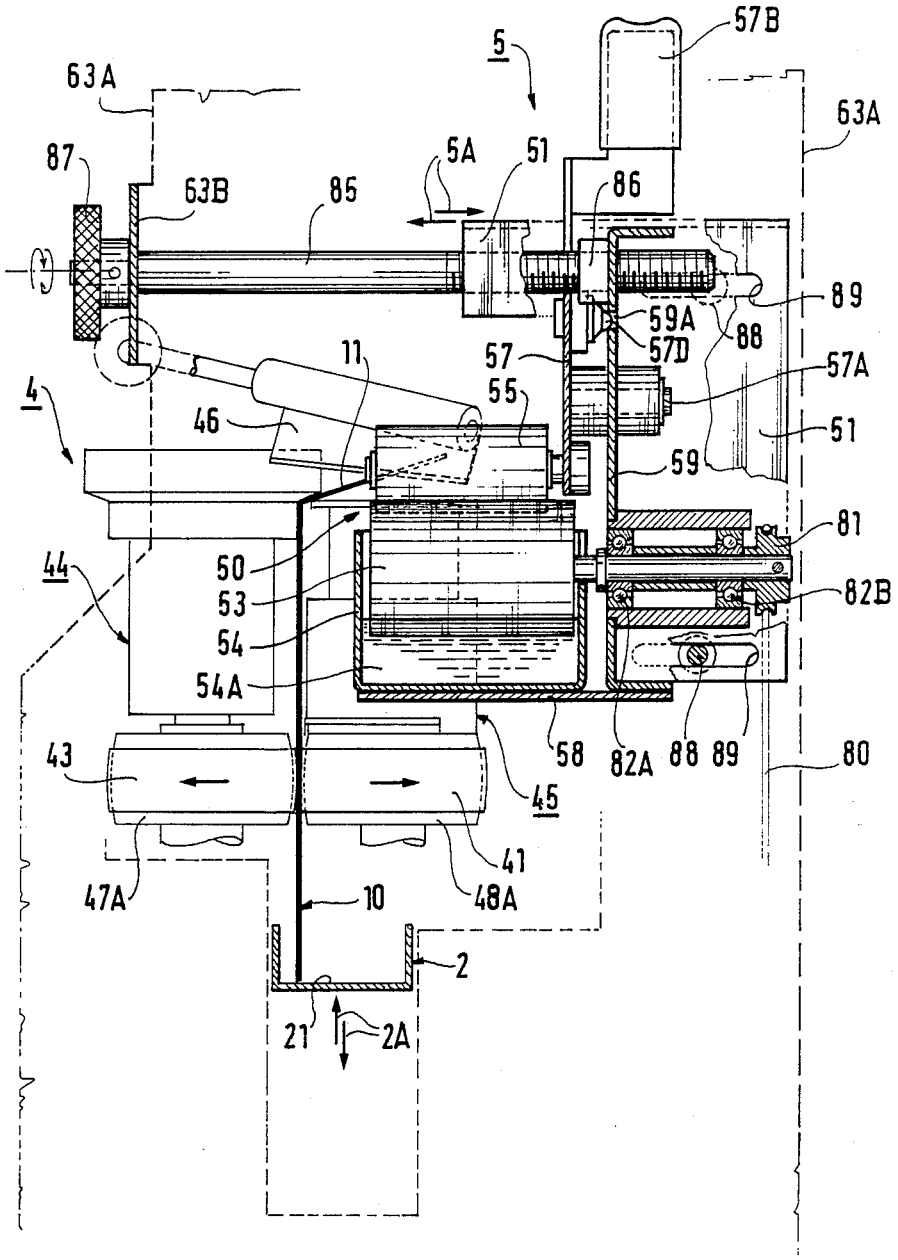
FIG. 7 is a view in vertical cross-section on more than one plane through the moistening station shown in FIGS. 5 and 6.

FIGS. 5, 6 and 7 show the moistening station 5 disposed immediately downstream of the folding station 4 that has just been described. In these figures the folding station 4 has been shown in thinner line for a better understanding of the functions of the moistening station after folding of the flap in the station 4. The essential component parts of the folding station 4 have been identified by the same reference numbers as previously designated them.

FIGS. 5, 6 and 7 show that the moistening station is mounted on the same side of the path 2 as the pulley wheel 45 and the rollers 48 and 48A on the aforementioned support 71 and above this support 71. Along the length of the path it is set back relative to the periphery of the rollers 48 and 48A carried by the support 71. It is at a small distance from the roller 48 and extends in part over the roller 48A. The moistening system 50 that it comprises is mounted on a flange 51 referred to as the moistening station flange. The flange 51 is in turn carried by one of the flanges 63A of the closing station which follows on from the moistening station in the device in accordance with the invention and which is shown in these figures although it forms part of the closing station situated downstream of the moistening station.

The moistening system 50 includes a moistening roller 53 with a horizontal axis and a water reservoir 54. The water level 54A in this reservoir is kept substantially constant. A water level sensor or some other means (not shown) controls the supply of water to the reservoir to maintain the level substantially constant. The moistening roller 53 is partially immersed in the water in the reservoir. A moistening counter-roller 55 is associated with the moistening roller 53. The moistening counter-roller 55 is retractable relative to the moistening roller 53, as will be explained hereinafter. The moistening counter-roller 55 is shown in full line in FIG. 5 at a small distance from the moistening roller; it is then said to be in the moistening position. In the moistening position it imparts curvature to the flap to force the gummed part of the flap against the moistening roller in an area referred to as the moistening area and designated by the reference number 53A. The moistening counter-roller 55 is shown in dashed line in FIG. 5 at a greater distance from the moistening roller 53; it is then said to be in the non-moistening retracted position.

FIG. 5 shows the line 16 which marks the start of the envelope flap on the envelope body and corresponds to the level of the end disk 45A of the pulley wheel 45 and also to the junction between the cylindrical bearing portion 44A and the frustoconical portion 44B of the pulley wheel 44. It is therefore seen that the reservoir 54 is entirely below the line 16 and that the moistening area 53A on the roller 53 is itself below this line 16. The moistening area 53A is short of the area 53B on the roller 55 to which the line 16 or the plane of the projecting disk 45A is tangential, being on the same side as the deflector flap 46.

Referring to FIGS. 5, 6 and 7 it is seen that the deflector flap 46 which maintains the folding done by the pulley wheels 44 and 45 in combination with the moistening counter-roller 55 links the folding station 4 to the moistening station 5. It guides the gummed end part of the envelope flap under the moistening counter-roller 55, whichever of its two positions the latter is in. In its moistening position the counter-roller presses the gummed end part of the flap against the moistening roller 53. It applies deformation to the gummed end part of the flap and presses the gummed side firmly onto the moistening roller. In its non-moistening retracted position it allows the flap to pass above the moistening roller without there being any contact between the gummed surface of the flap and the moistening roller 53.

The moistening system 50 also includes a pinch roller 56 associated with the moistening roller 53. It is mounted to press against the moistening roller 53 above the water level 54A and short of the moistening area 53A, on the same side as the folding station 4.

The moistening counter-roller 55 is mounted at the end of a lever 57 which places the moistening counter-roller in its moistening position or in its non-moistening retracted position. The lever lies above the reservoir 54 and the line 16 with the counter-roller 55 projecting from its end facing the reservoir 54 and the roller 53. This lever is mounted to pivot on a fixed pivot pin 57A. It carries or forms at the end opposite the counter-roller 55 a handle 57B accessible from above the moistening station. Its pivot pin 57A is offset laterally relative to the moistening counter-roller towards the flange 51. The lever is shown in full line in corresponding relationship to the moistening position of the counter-roller 55 that it carries; it is shown in dashed line in corresponding relationship to the non-moistening retracted position of the counter-roller 55 that it carries. The arrow 57C associated with the handle 57B represents its actuation to move the counter-roller 55 from the moistening position to the non-moistening retracted position.

In the moistening station 5 a horizontal support 58 carries the water reservoir 54. It is fixed to the bottom part of the flange 51. A vertical support 59 is also fixed to the flange 51 and the horizontal support 58. It defines the front wall of the moistening station, set back slightly relative to the forward edge of the flange 51. It is U-shaped in profile to give it sufficient rigidity. It carries the shafts (not referenced) of the moistening roller 53 and the pinch roller 56 and the pivot pin 57A of the lever 57.

The vertical support 59 also carries the drive mechanism of the moistening roller 53 visible in FIG. 7 provided by a drive belt 80 received through the front surface on the moistening drive pulley wheel 81. The shaft of the moistening roller rotate in ball bearings 82A and 82B.

The vertical support 59 and the lever 57 define the moistening and non-moistening retracted positions of the moistening counter-roller. To this end the lever 57 carries a positioning mechanism with a finger or ball 57D (referred to hereinafter as a ball) projecting towards the support 59 and the support 59 has in corresponding relationship two small circular openings 59A and 59B for receiving the ball in respective positions of the moistening counter-roller 55. The openings 59A and 59B define the limiting positions of the lever 57 as it pivot and hold it stable in these respective limit positions. By rubbing against the support 59, the ball also serves to guide the lever during its movement from one position to the other.

When the device in accordance with the invention operates the moistening counter-roller is placed in the moistening position or in the non-moistening retracted position according to whether or not the envelopes are to be moistened to close them with the flap stuck to the body of the envelope or closed without sticking down the flap. When moistening is required, the moistening roller is driven at substantially the same linear speed as that applied to the envelope bodies by the pair of belts in the folding station or at a lower speed to apply a smaller quantity of water. The moistening roller may be driven or not when moistening is not required, since it has no action on the gummed part of the flaps.

The mounting of the moistening station 5 into the device is described with reference to FIGS. 5 through 7 in which is shown the flange 63A which carries it, although this flange forms part of the closing station 6 and not of the moistening station 5.

The moistening station 5 is secured to the flange 63A by a rod 85 and by fingers 88. The rod 85 is horizontal and is locked relative to the flange 63A against a lug 63B through which it passes freely and which is stamped out of the flange 63A. It extends through the moistening station 5 in its upper part being above the articulation axis 57 of the lever 57 so as to be above the envelopes passing through the moistening station (FIG. 5) and is mounted through the vertical support 59 of the station 5 (FIGS. 6 and 7).

The rod 85 is screwthreaded for adjusting the depth of the moistening station relative to the device, in other words for specific positioning of the moistening station relative to the envelopes fed through it. The screwthreaded part of the rod 85 is received into a screwthreaded boss 86 fixed to the vertical support 59. At its opposite end the rod 85 carries a knurled knob 87 at the level of the lug 63B so that it can be operated from above the moistening station and the moistening station moved as shown by either of the arrows 5A. An adjustment of this kind is easily applied; it renders the moistening station adaptable t o different sizes of envelope flap and therefore to different envelope formats so that it receives between its moistening roller and its counter-roller only the gummed end parts of the flaps, whether they are to be moistened or not.

Two of the fingers 88 which together with the rod 85 secure the moistening station are disposed between the front end part of the flange 51 of the moistening station and the flange 63A (FIGS. 5 and 7). A third finger at the rear couples the moistening station to a flange 63A. They also guide the moistening station during its depth adjustment in the device. Each of the fingers 88 is held in a horizontal oblong slot 89 in the flange 51 adjacent its upper and lower edges and locked into the flange 63A. When the rod is actuated the fingers slide freely in their slots the ends of which define the limiting positions of the station.

Like the pulley wheels 44 and 45 of the folding station, the moistening station is kept at the same level and it is the channel 2 which is adjustable according to the envelope format processed by the device.

Figure 8:
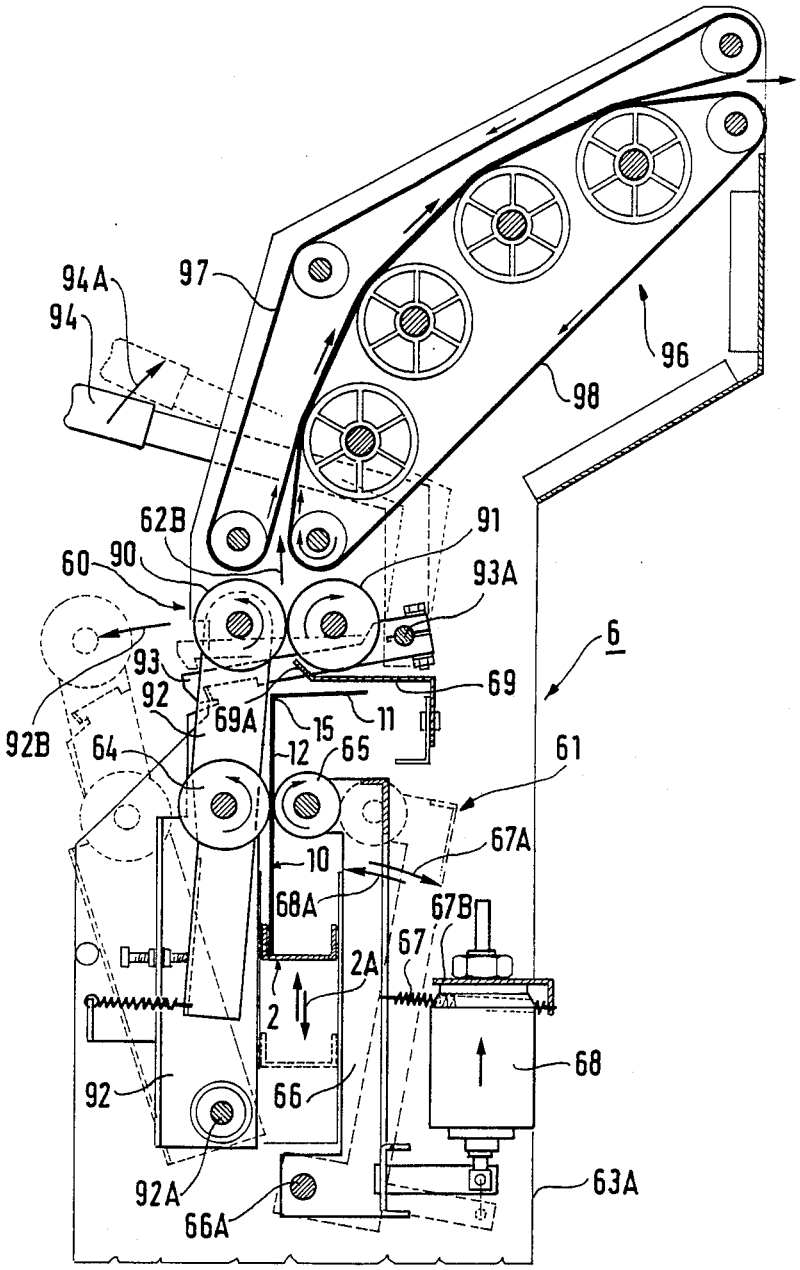
FIG. 8 is a view in cross-section on the line VIII—VIII in FIG. 1 of a closing station forming part of the folding device in accordance with the invention and which delivers the closed envelopes.

FIG. 8 shows the closing station 6 forming part of the device from FIG. 1 in cross-section; the station 6 is shown mounted between the previously mentioned flange 63A and another similar flange 63C. FIG. 1 shows that the closing device extends above the channel 2 and that its flange 63A is notched to allow free passage for the envelopes fed by the pairs of belts 41 of the folding station and stopped by the stop member 25 in the transfer system 61 of the closing station 6. The description of the closing station is given for the most part with reference to FIG. 8.

In the closing station 6 the transfer system 61 that it comprises is above the channel 2 but below the aforementioned line 16 (FIG. 1) corresponding to the level of the start 15 of the flap 11 on the body 12 of the envelope 10. The transfer system 61 includes a drive roller 64 and an associated counter-roller 65 disposed to receive the body of the envelope 10 between them. The roller 64 is mounted between the flanges 63A and 63C. The counter-roller 65 is disposed to press against the roller 64 or to be moved away from it. It is carried by a pair of arms 66 which at the end opposite the counter-roller are coupled together and pivot on a shaft 66A carried by the flanges 63A and 63C.

A spring 67 coupled to the arms 66 urges them as shown by the arrow 67A against an abutment member 63B to move the counter-roller 65 into a position away from the roller 64. A solenoid 68 also coupled to the arms pivots them as shown by the arrow 68A against the action of the spring 67 to press the counter-roller against the roller. In the position away from the roller 64 the counter-roller 65 allows an envelope to come between it and the roller 64 to be stopped against the stop member and await transfer. In the position pressed against the roller 64 the counter-roller 65 grips the envelope awaiting transfer between itself and the roller. A detector responding to the presence of an envelope awaiting transfer (not shown) commands the solenoid or enables it to be commanded when this is done at the operating rate of the device.

The transfer system is further provided with a horizontal plate 69 for holding the flap 11 folded. This plate is mounted above the roller 64 and the counter-roller 65 so as to receive under itself the end part of the envelope flaps. It maintains the folding done in the folding station, as do the deflector flap of the folding station and the moistening counter-roller of the moistening station. The edge 69A of the plate 69 towards the start 15 of the flap 11 is bent upwardly to form an entry guiding the flap into the closing station 60.

The closing station 60 is disposed just above the plate 69 so as to be above the level of the envelope 10 arriving to await transfer without contacting it during this wait for transfer. It comprises two drive rollers 90 and 91 pressed strongly against each other in substantial vertical alignment with the body of the envelope awaiting transfer. During transfer of the envelope the folded over edge 69A guides the flap 11, folding it completely against the body of the envelope. The start 15 of the flap and the flap in its entirety are then pressed firmly against the body of the envelope between the two rollers 90 and 91. The flap is stuck to the body of the envelope if its gummed part was previously moistened, otherwise it is not stuck down.

As shown in FIG. 8, to avoid possible jams that could arise in the transfer system 61 and closing system 60, the rollers 64 and 90 on the same side are advantageously not carried directly by the flanges 63A and 63C but by a pair of arms 92 pivoting about an end shaft 92A opposite the roller 90 and mounted between the flanges 63A and 63C. They therefore enable the closing station to be opened up, as symbolically represented by the arrow 92B. These arms are normally held locked in position between the flanges by a pair of locking pawls 93 engaged with a tooth provided on the arms. These pawls pivot to unlock them. They are carried by a shaft 93A passing through the flanges 63A and 63C. A handle 94 outside one of the flanges and operated as shown by the arrow 94A serves to unlock the pawls 93 on the arms 92. For reasons of illustration, in the cross-section view given in FIG. 8 the handle 94 is shown mounted on the side of the flange 63A which carries the previously described moistening station. In practise it is preferably fixed to the outside of the other flange of this closing station, which is free on the side of the device.

The closing station is further provided with an outlet system 96 for the envelopes closed in the closing system 60. It extends over the closing system 60 and is mounted between the flanges 63A and 63C so as to confer an arcuate trajectory on the envelopes to turn them through 90° and feed them out flat. The output system 96 comprises a pair of belts 97 and 98 between which the envelopes are fed along this arcuate output path.

The advantages of this device include:

particularly easy implementation of the device, which does not comprise any complex shape profiled members, its compact overall dimensions, the independence of the flap folding and gummed part moistening operations, which enables envelopes to be closed with their flaps stuck down or not and corresponding mailing at different rates, easy adaptation of the device to different envelope formats, both with regard to folding of the flap and with regard to moistening or non-moistening of the gummed part of flaps of different sizes, reliable and fast operation of the device, with the rate of operation easily varied, easy access to the interior of the device should any jam need to be cleared, simple mounting of the stations of the device, with automatic adaptation to different envelope thicknesses.

The present invention has been described with reference to the embodiment shown in the appended drawings. It is obvious that without departing from the scope of the invention it is possible to replace certain means with other equivalent means and/or to introduce adaptations depending on how the envelopes to be closed are fed or how the closed envelopes are subsequently processed. In particular, if the envelopes are fed flat on a horizontal guide path the moistening roller with its axis perpendicular to the movement of the envelopes is mounted under the guide path with its axis vertical. The moistening area will always be slightly set back relative to the gummed part of the flap forced into a folded position, the counter-roller in the moistening position guiding this gummed part against the moistening area and in the non-moistening retracted position allowing the gummed area to pass freely without contact with the moistening area.

There is claimed:

1. Device for folding over the flaps of envelopes received separately with the flap open at the entry to a guide path, the device comprising feed means for moving the envelopes along said path and deflector means for folding the flaps of the envelopes over from an open position to a closed position and said deflector means comprising first and second pulley wheels with parallel rotation axes disposed with respect to said entry and one on each side of said path so as to receive the envelopes between them, wherein said first pulley wheel is adapted to face towards the front of the envelopes and has a stepped peripheral surface formed by a cylindrical first portion adapted to bear on at least that portion of each envelope adjoining the flap and a frustoconical second portion extending from said first portion and widening towards the flaps of the envelopes and said second pulley wheel has a peripheral surface formed by a cylindrical first portion opposite said first .portion of said first pulley wheel and radially set back relative to the envelopes and a projecting disk at the end of said first portion situated beneath said frustoconical portion of said first pulley wheel and substantially aligned with the junction between said first and second portions of said first pulley wheel in order to fold the flaps of the envelopes down from said open position to an intermediate position in which the flap is substantially perpendicular to the remainder of the envelope.

2. Device according to claim 1, wherein said peripheral surface of said first pulley wheel further comprises a cylindrical third portion projecting relative to said first portion to which it is joined by said second portion.

3. Device according to claim 1, further comprising a deflector flap facing said first pulley wheel and said disk of said second pulley wheel and extending downstream of said pulley wheels in the direction of movement of the envelopes along said path to constitute an obstacle preventing the flaps of the envelopes from unfolding, said deflector flap and said pulley wheels together constituting a folding station.

4. Device according to claim 3, wherein in the upstream to downstream direction said deflector flap is inclined towards the direction of movement of the envelopes.

5. Device according to claim 4, wherein in the direction transverse to that in which the envelopes move along said path said deflector flap is inclined towards said second pulley wheel.

6. Device according to claim 3, wherein at least said first pulley wheel is a driving wheel and is adapted to rotate at such a speed that its peripheral linear speed is equal to that of said feed means.

7. Device according to claim 6, further comprising respective shafts on which said first and second pulley wheels are mounted and respective first rollers of a first pair of pressure rollers forming part of said feed means carried by said shafts.

8. Device according to claim 7, further comprising two second rollers forming a second pair of pressure rollers downstream of said first pair of pressure rollers and also forming part of said feed means and wherein said first and second pulley wheels and their respective first rollers are coupled to respective second rollers.

9. Device according to claim 7, further comprising a pivoting support and a shaft on which said pivoting support rotates and wherein one of said pulley wheels and the respective first and second rollers associated therewith and on the same side of said path thereas are mounted on said pivoting support, said shaft being disposed between the rotation axes of said respective first and second rollers, the device also comprising spring means acting on said pivoting support to urge each roller carried thereby against the corresponding other roller of each of said first and second pairs of rollers.

10. Device according to claim 9, wherein said pulley wheels and said deflector flap are fixed and said guide path incorporates means for adjusting said guide path in the plane of the fed envelope so that the junction of the envelope flap with the remainder of the envelope always lies on a reference line aligned with said end disk of said second pulley wheel and substantially aligned with the junction between said first and second portions of said first pulley wheel.

11. Device according to claim 10, further comprising a moistening station incorporating a transversely disposed moistening roller downstream of said second pulley wheel relative to the plane of the fed envelope and on the same side of said path as said second pulley wheel with is peripheral surface in substantially tangential relationship to the plane of said end disk of said second pulley wheel and a counter-roller opposite said deflector flap and defining a moistening area on said moistening roller on the same side thereof as said deflector flap and set back relative to the plane of said end disk of said second pulley wheel, wherein said counter-roller and said deflector flap link said folding and moistening stations and continue the folding operation initiated by said pulley wheels and said deflector means further comprise a system adapted to close the flaps of the envelopes after they are moistened.

12. Device according to claim 11, wherein said counter-roller is retractable relative to said moistening roller, moving between a moistening position in which it is close to said moistening area and a retracted position in which it is spaced from said moistening roller and allows the envelopes to pass without the flap touching said moistening roller.

13. Device according to claim 12, further comprising a pivoting lever on which said counter-roller is mounted and by means of which said counter-roller is retracted relative to said moistening roller.

14. Device according to claim 13, further comprising a support for said lever, said moistening roller and said counter-roller, a flange at said moistening station to which said support is fixed and a positioning mechanism coupling said lever and said support and defining two limiting positions of said lever corresponding to said moistening and retracted positions of said counter-roller.

15. Device according to claim 14, further comprising a flange and an adjustment rod and guide fingers coupling said flange to said flange at said moistening station, whereby the position of said moistening station is adjustable transversely to said guide path for alignment with said flaps of the envelopes.

16. Device according to claim 11, wherein said means for closing the flaps of the envelopes comprise a pair of drive rollers adapted to be pressed into contact with each other facing and spaced from said guide path so that they are not in direct contact with envelopes on said path and further comprising envelope transfer means downstream of said moistening station on both sides of said path and the envelopes thereon adapted to transfer said envelopes with the start of the flap towards the front of said closing means, with which it constitutes a closing station.

17. Device according to claim 16, wherein said transfer means comprise a drive roller, a transfer roller and a pivoting arm on which said transfer roller is mounted and by which said transfer roller is pressed against said drive roller or separated therefrom.

18. Device according to claim 17, further comprising a pair of arms carrying at least said transfer roller and latching means selectively operable to release said arms and thereby open said closing station.

19. Device according to claim 16, wherein said guide path is formed by a U-shaped cross-section horizontal channel having a bottom on which the bottom edges of the envelopes rest as they are fed along said channel in a vertical position.

20. Device according to claim 19, wherein the entry to said guide path forms an entry station and comprises a drive roller on one side of said channel and a counter-roller on the other side of said channel, means being provided for pressing said drive roller and said counter roller together or for separating them, and said drive roller and said counter-roller being part of said feed means.

21. Device according to claim 19, further comprising an end abutment member closing off the end of said channel and wherein said closing station is mounted on the end part of said channel including the end closed off by said abutment member.

22. Device according to claim 21, wherein said end part has a length substantially equal to a predefined maximum envelope length and the position of said abutment member on said end part is adjustable.

23. Device according to claim 21, further comprising a check pawl on said pivoting support of one of said pulley wheels and the respective first and second rollers having an edge which projects relative to the periphery of said second roller into said channel.

24. Device according to claim 23, further comprising a coupling with clearance transverse to said channel by which said check pawl is coupled to said second roller and wherein said check pawl rotates about the same axis as said pivoting support, the device also comprising spring means for causing said check pawl to project relative to the periphery of said second roller.

* * * * *